US006896148B2

(12) United States Patent
Whyte

(10) Patent No.: US 6,896,148 B2
(45) Date of Patent: May 24, 2005

(54) MINI WALNUT BASKET SHELL

(76) Inventor: Leonard James Whyte, 400 Victoria Ave., Wilmington, DE (US) 19804

( * ) Notice: Subject to any disclaimer, the term of this patent is extended or adjusted under 35 U.S.C. 154(b) by 382 days.

(21) Appl. No.: 10/126,836

(22) Filed: Apr. 19, 2002

(65) Prior Publication Data

US 2003/0197015 A1 Oct. 23, 2003

(51) Int. Cl.[7] ..... B65D 6/02
(52) U.S. Cl. ..... 217/122
(58) Field of Search ..... 217/122–125; 220/634; D3/304, 307, 309; D11/148

(56) References Cited

U.S. PATENT DOCUMENTS 450,112 A * 4/1891 Snow ..... 217/122
5,752,469 A * 5/1998 Carbonell ..... 119/482

OTHER PUBLICATIONS

Rock–a–Bye Baby: Walnut Crate, make–stuff.com, Jan. 27, 2002.*

Walnut Treasure Chest, make–stuff.com, Jan. 27, 2002.*

Things you can do with walnut shells, make–stuff.com, Jan. 27, 2002.*

Shell Baskets, Shell Horizons, date unknown.*

* cited by examiner

*Primary Examiner*—Stephen Castellano

(57) ABSTRACT

A mini basket made from one walnut shell is provided. The basket is a novelty item useful in enhancing decorative displays and may be included with other craft items to form an artistic and pleasing arrangement.

6 Claims, 1 Drawing Sheet

MINI WALNUT BASKET SHELL

BACKGROUND OF THE INVENTION

The invention relates to a mini basket made from a walnut shell. Such baskets are useful as novelty items, and some paint and a degree of creativity can turn them into works of art.

SUMMARY OF THE INVENTION

A mini basket made from one walnut shell is provided. The basket has a bottom, at least one side wall connected to and extending upwardly from the bottom to an upper edge, wherein the bottom and side wall define a cavity. The basket includes a bail connected to and extending upwardly from two diametrically opposed portions of the upper edge with the upper edge, defining an opening for accessing the cavity. The side wall and bail consist of the walls of the walnut shell, wherein the walls of the walnut shell include the entire shell seam which separates the walnut shell into two substantially equal halves, wherein the shell seam is oriented vertically. The shell seam traverses the entire longitudinal extent of the bail and extends vertically down along two diametrically opposed portions of the side wall from the upper edge of the side wall to the bottom. The shell seam extends across the bottom of the basket. The opening for accessing the cavity is formed by two diametrically opposed horizontal cuts in the walnut shell and the bail is formed by two vertical cuts adjacent to the shell seam, with each vertical cut intersecting one of the two horizontal cuts. The basket is not typical of a walnut shell missing two cracked portions of the shell. The basket preferably has a separate base affixed to the bottom. Preferably being a washer affixed to the bottom. The washer may be a copper washer, may be made of wood, and is preferably affixed to the bottom by glue.

DETAILED DESCRIPTION OF THE INVENTION AND PREFERRED EMBODIMENTS WITH REFERENCE TO THE DRAWINGS

Figure 1A:
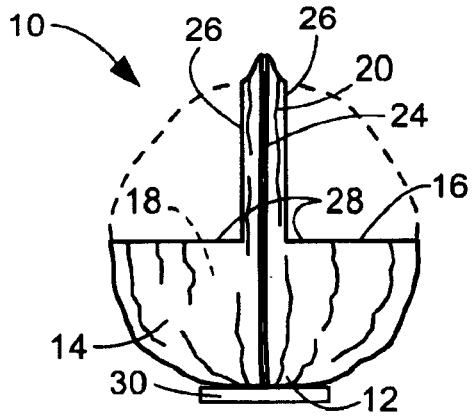
FIG. 1A is a side elevation of one walnut shell mini basket according to the invention.

According to the invention, a novelty item mini basket is fashioned from an ordinary walnut shell. With reference to FIG. 1A the basket 10 includes a bottom 12 with side wall 14 extending upwardly from the bottom 12 to upper edge 16, with the bottom 12 and wall 14 and edge 16 all defining cavity 18. Bail 20 is connected to and extends upwardly as shown from two diametrically opposed portions of upper edge 16, with the upper edge 16 defining the opening into basket 10. The wall 14 and bail 20 include the entire walnut shell seam 24 which separates the original walnut into two substantially equal halves. The seam 24 is oriented vertically, and traverses the entire longitudinal extent of the bail 20 and extends vertically down along two diametrically opposed portions of side wall 14 from edge 16 to bottom 12, extending across bottom 12. The opening 18 is formed by two diametrically opposed horizontal cuts 28, and the bail 20 is formed by two vertical cuts 26, shown in phantom, adjacent the shell seam 24, each vertical cut 26 intersecting one of the horizontal cuts 28. Base 30, preferably in the shape of a washer, is affixed to bottom 12 such as, for example, by glue.

Figure 1B:
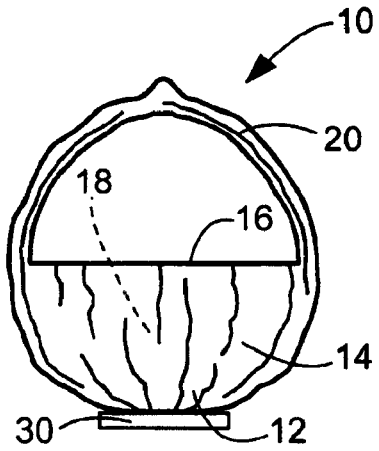
FIG. 1B is a front elevational view of the basket shown in FIG. 1A.

FIG. 1B is a front elevational view of the basket 10 having bottom 12, wall 14 extending to top edge 16, which circumscribes opening 22 into the cavity 18, and bail 20, containing seam 24 and formed by vertical cuts 26 and horizontal cuts 28, the basket being stabilized by base 30 affixed to bottom 12, preferably by glue.

Figure 1C:
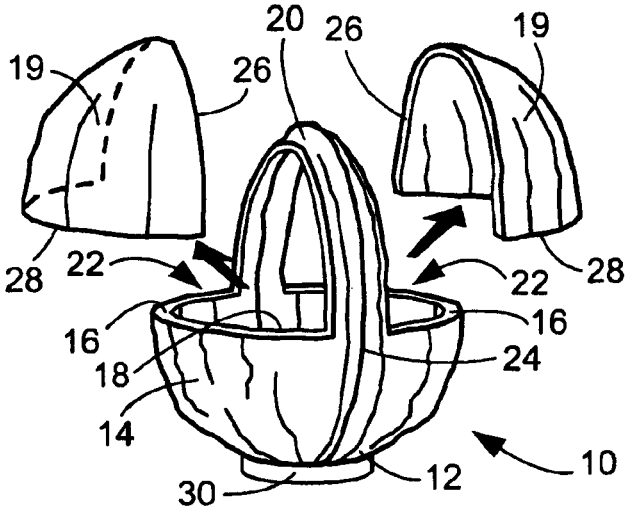
FIG. 1C is a perspective view of the mini basket of the invention shown in FIGS. 1A and 1B.

FIG. 1C shows basket 10 in a perspective view, including bottom 12, wall 14, upper edge 16 defining the opening 22 into cavity 18, and bail 20, having included seam 24, all resting on base 30 affixed to bottom 12. The cut-outs 19 formed by vertical cuts 26 and horizontal cuts 28 are illustrated for completeness. They are discarded and form no part of the invention.

Figure 1D:
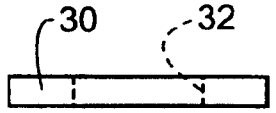
FIG. 1D is an elevational view of a base for attachment to the bottom of the carved walnut shell basket of the invention in one embodiment thereof.
Figure 1E:
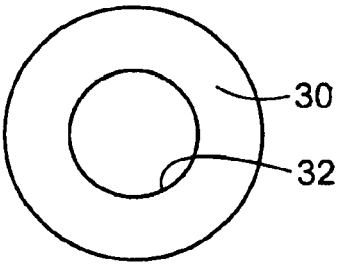
FIG. 1E is a top plan view of the base depicted in FIG. 1D.

FIGS. 1D and 1E are front elevation and top plan views, respectively, of base 30. Base 30 is preferably a washer having center opening 32, but it may be a disc. Most preferably, base 30 is a copper washer, but a disc or ring of copper or plastic is also effective.

A mini walnut basket, article is thus provided comprising of a walnut shell made into a mini basket from a walnut shell in 4 parts. Part #1: Bottom of wide end is ground flat. Part #2: A $\frac{5}{8}$×$\frac{3}{32}$" ring washer to be added to flattened end or bottom of walnut shell. Part #3: A small quantity of glue is added to glue $\frac{5}{8}$"×$\frac{3}{32}$ washer to bottom of shell flat end. Part #4: Copper washer clamped to center of bottom end of shell until glue sets up. Solidifies in 10 to 14 hours. Walnuts come in many sizes and shapes. Normal ones are picked for mini walnut baskets for size and shape.

After copper ring washer is attached to walnut shell and is cured, it is then marked for cutting. It is marked in 4 places, 2 places each side opposite to one another. Marked for cutting into a mini basket: 1" up from bottom, for smaller sizes, ¾" up from bottom, varies in height. Each side of marking is on each side of ribs. Each walnut shell has 2 ribs.

Now walnut shell is ready to be cut into mini baskets. Cutting on marks already on walnut shell. Marks vary in height from bottom ¾" to 1", depending on size of walnuts. This after glue has cured and copper washer is quite firm. To take a handle grip, a handle must be made and attached to walnut shell. To handle walnut shells while cutting, I made a handle from a pair of pliers. A Dremel High-speed cutting wheel, 30,000 rpms makes it necessary to have a handle for safety attached to walnut shell.

A pair of pliers is altered and ground to fit copper washer on bottom of walnut shells. Jaws of pliers are ground half round and make a good handle. A spring is attached to pliers handles to keep a grip on bottoms of walnut shell washers, ½", $\frac{9}{16}$", ¾" sizes, handles all sizes.

A high speed Dremel motor 30,000 rpms is used to cut walnut shells as they are hard as iron. Safety has to be exercised in cutting mini walnut basket shells. The pliers are held in left hand, Dremel motor is held in right hand. The walnut is resting on a block of wood in pliers jaws to steady walnut shell. Left hand rotates walnut shell to the right, right hand rotates Dremel cutting wheel to right and left. Each hand helps each other in cutting walnut shell. This method is used until a better way is found.

A walnut shell is made into a mini walnut shell basket with a copper ⅝"×3⁄32" washer glued to the bottom of the wide part of the walnut shell to form a bottom and hold walnut shell in an upright position standing. Top part of shell is cut and saved to form a handle for the mini shell basket. After side pieces are cut out, ribs are saved for top handle.

A walnut shell to be cut with a High-speed cutting wheel Dremel motor 30,000 rpms special cutting disc. The shell of a walnut is very hard, like iron. A handle had to be made. Designed from a pair of pliers to be attached to a walnut shell in order to control cutting with a high-speed motor and cutting disc wheel.

A holding tray was made to hold walnut shells for gluing washers onto bottom and let glue cure for 10 to 14 hours. Many are done at one time. After glue is cured, walnut shells are marked for cutting approximately ¾" up from bottoms. Top half is marked for handle. After cutting, all shells are cleared of all nuts, membranes, and pulp and finished with a small grinding wheel to a finished mini basket from a walnut shell.

Pliers may be used to hold a walnut while cutting it to shape for both ease of handling and for safety.

Suitable bases to be glued to the bottom of a cut walnut, to add stability to the finished basket, include, without limitation, washers, such as common copper washers, short sections of copper rings or the like cut from copper pipe, and short sections cut from plastic pipe, all sized according to the particular walnuts being supplied.

It is a novelty craft, and fun to make. I had to come up with ways and means to handle such a small article. I called on past experience to find ways to make a Mini Basket from a walnut shell. One has to wear safety equipment: goggles, air filter and have a dust fan to take dust out of the room or building. A walnut shell can make a lot of dust. A handle to attach to the walnut shell for cutting was one answer.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A basket made from one walnut shell, the basket comprising:

a bottom, at least one side wall connected to and extending upwardly from said bottom to an upper edge, said bottom and side wall defining a cavity, and a bail connected to and extending upward from two diametrically opposed portions of said upper edge, said upper edge defining an opening for accessing said cavity;

said side wall and bail consisting of the walls of said walnut shell, said walls of the walnut shell include the entire shell seam which separates the walnut shell into two substantially equal halves, said shell seam being oriented vertically, the shell seam traversing the entire longitudinal extent of the bail and extending vertically down along two diametrically opposed portions of said side wall from said upper edge of said side wall to said bottom, said shell seam extending across the bottom of the basket;

said opening for accessing said cavity formed by two diametrically opposed horizontal cuts in said walnut shell and said bail formed by two vertical cuts adjacent to the shell seam, each vertical cut intersecting one of the two horizontal cuts, wherein said basket having said opening and said handle is not typical of a walnut shell missing two cracked portions of the shell.

2. The basket of claim 1 having a separate base affixed to said bottom.

3. The basket of claim 2 wherein said base is a washer affixed to said bottom.

4. The basket of claim 3 wherein said washer is a copper washer.

5. The basket of claim 3 wherein said washer is made of wood.

6. The basket of claim 2 wherein said base is affixed to said bottom by glue.

* * * * *